US006158462A

United States Patent [19]

Kashiwagi et al.

[11] Patent Number: 6,158,462

[45] Date of Patent: Dec. 12, 2000

[54] HYDRAULIC PRESSURE CONTROL DEVICE

[75] Inventors: Masao Kashiwagi; Masayuki Nakamura, both of Sagamihara, Japan

[73] Assignee: Kayaba Industry Co., Ltd., Japan

[21] Appl. No.: 09/136,669

[22] Filed: Aug. 19, 1998

[30] Foreign Application Priority Data

Aug. 26, 1997 [JP] Japan ..... 9-244549

[51] Int. Cl.[7] ..... F15B 11/042

[52] U.S. Cl. ..... 137/596; 60/427; 60/452; 91/446; 91/518; 137/596.13

[58] Field of Search ..... 60/427, 452; 91/446, 91/518; 137/596, 596.13

[56] References Cited

U.S. PATENT DOCUMENTS 5,305,789 4/1994 Rivolier ..... 91/446 X

*Primary Examiner*—Gerald A. Michalsky
*Attorney, Agent, or Firm*—Steinberg & Raskin, P,C.

[57] ABSTRACT

The present invention is directed to a hydraulic pressure control device which can overcome problems, such as a shock to an actuator or a pressure boost phenomenon involving a rapid increase in pump delivery pressure, conventionally encountered when a directional control valve is switched. The hydraulic pressure control device is constructed such that first and second connecting ports are connected to a tank when a directional control valve is in its neutral position, one of the first and second connecting ports is cut off from the tank and connected to an actuator and the other is cut off from the tank and closed when the directional control valve has been switched, in accordance with a position to which the directional control valve has been switched, and a maximum pilot pressure selectively taken from between a pressure compensating valve and a pair of check valves is introduced into a pilot line.

1 Claim, 6 Drawing Sheets

HYDRAULIC PRESSURE CONTROL DEVICE

BACKGROUND OF THE INVENTION AND RELATED ART STATEMENT

1. Field of the Invention

The present invention relates to a hydraulic pressure control device for controlling the delivery pressure of a pump in accordance with maximum load pressure of actuators.

2. Description of the Related Art

FIGS. 5 and 6 show an example of a conventional hydraulic pressure control device.

As can be seen from FIG. 5, this hydraulic pressure control device has a dual valve construction incorporating a pair of directional control valves 2 of the same structure and circuit configuration. The following discussion depicts the structure of one of the directional control valves 2 and its associated circuit.

Referring to FIG. 5, a pump P is connected to a pump port 3 of the directional control valve 2 through a supply line 1. The supply line 1 remains always connected to conduct a fluid regardless of whether the directional control valve 2 is set to its neutral position or switched to a right or left position, and a far end of the supply line 1 is closed.

An unillustrated actuator is connected to a pair of actuator ports 4, 5 of the directional control valve 2. These actuator ports 4, 5 are closed when the directional control valve 2 is in its neutral position.

The directional control valve 2 also has a interconnecting port 7 which is connected to an inflow side of a pressure compensating valve 6. The interconnecting port 7 is closed when the directional control valve 2 is set to its neutral position, and is connected to the pump port 3 when the directional control valve 2 is switched to its right or left position. The opening of a variable throttle 8 formed between the interconnecting port 7 and the pump port 3 is determined such that the opening becomes proportional to the travel of switching of the directional control valve 2.

An outflow side of pressure compensating valve 6 is connected to a connecting port 9 of the directional control valve 2, with a check valve 10 provided between the pressure compensating valve 6 and the connecting port 9 to allow flow from the pressure compensating valve 6 to the connecting port 9 only.

The connecting port 9 is connected to a tank port 11 when the directional control valve 2 is set to its neutral position, to the actuator port 5 when the directional control valve 2 is switched to the left position, and to the actuator port 4 when the directional control valve 2 is switched to the right position of FIG. 5.

A pilot pressure is taken out from a line between the connecting port 9 and the tank port 11, the actuator port 4 or the actuator port 5.

One of pilot pressures thus obtained from the directional control valves 2 whichever higher is selected by a shuttle valve 12 and led to a pilot line 13.

The selected higher pilot pressure is led to a pilot chamber at one end of the pressure compensating valve 6. One the other hand, a pressure on the upstream side of the relevant pressure compensating valve 6 is led to a pilot chamber at the other end of the pressure compensating valve 6.

The pressure compensating valve 6 thus configured serves to keep the pressure on its upstream side higher than the pilot pressure introduced from the pilot line 13 by a pressure differential corresponding to an elastic force exerted by a spring 14.

The selected higher pilot pressure is also led to a pilot chamber at one end of a regulator valve 15 through the pilot line 13. One the other hand, pump delivery pressure is led to a pilot chamber at the other end of the regulator valve 15.

The regulator valve 15 thus configured serves to generate a control pressure from the pump delivery pressure in accordance with the pilot pressure of the pilot line 13 and the pump delivery pressure. When the control pressure is supplied to a regulator 16, the regulator 16 controls the angle of inclination of a rotary member of the pump P and keeps its delivery pressure higher than the pilot pressure by a specified amount.

Operation of this hydraulic pressure control device is now described.

When the directional control valve 2 is in its neutral position, the actuator ports 4, 5 are closed and, thus, a current load of the actuator is maintained as it is. Since the connecting port 9 is connected to the tank port 11 and the internal pressure of the pilot line 13 is equal to a tank pressure in this case, the pump delivery pressure is maintained at a relatively low standby pressure which is higher than the tank pressure by a specified amount.

If the directional control valve 2 is switched to the left position of FIG. 5, the pump port 3 is connected to the interconnecting port 7. In this case, the pump delivery pressure is controlled by the variable throttle 8 and led to the relevant actuator by way of the pressure compensating valve 6, the connecting port 9 and the actuator port 5 in this order.

One the other hand, return oil from the actuator is returned to the tank port 11 through the actuator port 4. Thus, the actuator is driven. At this point, the maximum load pressure among load pressures of individual actuators is selected by the shuttle valve 12 and led to the pilot line 13.

The pump delivery pressure or the pressure on the upstream side of the variable throttle 8 is maintained at a pressure which is higher than the maximum load pressure of the individual actuators by a specified amount by the regulator valve 15 and the regulator 16.

At the same time, the pressure on the upstream side of the pressure compensating valve 6 or the pressure on the downstream side of the variable throttle 8 is maintained at a pressure which is higher than the pilot pressure by the pressure corresponding to the elastic force exerted by the spring 14.

This means that the pressure differential between the upstream side and the downstream side of the variable throttle 8 is kept constant. It is therefore possible to maintain a constant actuator speed if the opening of the variable throttle 8 is determined in accordance with the travel of switching of the directional control valve 2 and the rate of flow through the variable throttle 8 is thereby determined.

Operation of the hydraulic pressure control device is simply reversed when the directional control valve 2 is switched in the right direction as illustrated. Thus, a detailed description of this case is omitted.

FIG. 6 shows a more specific example of the directional control valve 2, the pressure compensating valve 6 and the check valve 10 of the aforementioned conventional hydraulic pressure control device.

A spool 19 is slidably fitted in a spool hole 18 formed in a valve body 17.

A pair of tank ports 11*a* are formed at both sides of the valve body 17 and a pair of actuator ports 4, 5 are provided on the inside of the tank ports 11*a*. Further, a pair of connecting ports 9 are formed on the inside of the actuator ports 4, 5. Accordingly, when the spool 19 is switched to its right or left direction, through an annular groove 20, one of the actuator ports 4, 5 is connected to its corresponding connecting port 9 and the other is connected to its corresponding tank port 11*a*.

The connecting ports 9 are individually connected to a pilot line 13 which is not illustrated. Tank ports 11*b* are formed also on the inside of the connecting ports 9 so that the connecting ports 9 are connected to the respective tank ports 11*b* when the spool 19 is set to its neutral position as shown in FIG. 6.

A interconnecting port 7 is formed approximately in the middle of the valve body 17 and a pair of pump ports 3 are provided on both sides of the interconnecting port 7. Thus, the interconnecting port 7 is connected to the pump ports 3 no matter whether the spool 19 is switched in its right or left direction. As described earlier in connection with FIG. 5, a variable throttle 8 is formed between the interconnecting port 7 and each pump port 3 and the opening of the variable throttle 8 is determined such that the opening becomes proportional to the travel of switching of the spool 19.

The directional control valve 2 thus constructed integrally incorporates the pressure compensating valve 6 and the check valve 10.

An assembly hole 22 perpendicular to the spool hole 18 is formed approximately in the middle of the valve body 17, a lower end of the assembly hole 22 being connected to the interconnecting port 7. Right and left side portions of the assembly hole 22 are connected to the right and left connecting ports 9 through a pair of passages 23, respectively.

A movable sleeve 44 is slidably fitted in the assembly hole 22, an upper end of the movable sleeve 44 being closed by a closing member 24.

Further, a poppet 25 is fitted in the movable sleeve 44. The internal pressure of the passages 23 is led to a back pressure chamber of the poppet 25 through connecting holes 21 formed in right and left side portions of the movable sleeve 44 and the poppet 25.

The poppet 25 is brought into contact with a seating surface formed within the movable sleeve 44 by a spring 26 provided between the closing member 24 and the poppet 25. In this condition, control holes 27 formed on both the right and left side portions of the movable sleeve 44 are cut off from the interconnecting port 7 by the poppet 25.

A cover 28 is fixed onto the valve body 17 covering the movable sleeve 44 and the closing member 24.

The closing member 24 is disposed so that its upper end faces a pilot chamber 29 formed in the cover 28 and an elastic force of a spring 14 is exerted on the upper end of the closing member 24. As a result, the movable sleeve 44 is forced against the lower end of the assembly hole 22 by the elastic force of the spring 14. In this condition, the control holes 27 formed on the right and left side portions of the movable sleeve 44 are cut off from the passages 23.

A pilot pressure taken from the pilot line 13 is introduced into the pilot chamber 29.

It is now assumed that the spool 19 has just been switched from the neutral position shown in FIG. 6 in a direction shown by an arrow k.

As the pump ports 3 are connected to the interconnecting port 7 with their opening corresponding to the travel of switching of the spool 19 in this case, oil delivered from a pump is introduced into the assembly hole 22 and acts on a lower end of the movable sleeve 44 and the poppet 25. Consequently, the movable sleeve 44 moves upward overwhelming the pushing force of the spring 14 and the control holes 27 open to the passages 23. At this point, the pump delivery pressure causes the poppet 25 to come apart from the seating surface and the pump delivery pressure controlled by the control holes 27 is led to the connecting ports 9 through the passages 23.

In this case, both of the connecting ports 9 are cut off from the tank ports 11*b* while the connecting port 9 beside the actuator port 5 is connected to the actuator port 5 through an annular groove 20. Control pressure led to this connecting port 9 is thus supplied to an unillustrated actuator through the actuator port 5. Since the actuator port 4 is connected to the left-hand tank port 11*a* through another annular groove 20 at the same time, return oil from the actuator is discharged through the actuator port 4 and the left-hand tank port 11*a*.

As described earlier, one of load pressures of individual actuators led to the connecting ports 9 whichever higher is selected by the shuttle valve 12 and introduced into the unillustrated pilot line 13 at this point.

The maximum load pressure of one actuator is then led to the pilot chamber 29, whereby the position of the movable sleeve 44 is determined in accordance with the pressure at the interconnecting port 7 and the maximum load pressure of the actuator. Thus, the pressure at the interconnecting port 7 is controlled according to the current opening of the control holes 27 and kept higher than the pilot pressure by a pressure differential corresponding to the elastic force exerted by the spring 14.

The pump delivery pressure at the pump ports 3 is kept higher than the maximum load pressure of the actuators by a specified amount by a regulator valve 15 and a regulator 16 as described earlier.

This means that the pressure differential between the upstream side and the downstream side of the variable throttle 8 is kept constant. It is therefore possible to maintain a constant actuator speed if the opening of the variable throttle 8 is determined in accordance with the stroke of the spool 19 and the rate of flow through the variable throttle 8 is thereby determined.

Since the pilot line 13 is connected to the relevant tank port 11 when the directional control valve 2 is in its neutral position in the above-described conventional hydraulic pressure control device, the pump delivery pressure is kept at a relatively low standby pressure. When the directional control valve 2 is switched from the neutral position to another position, the pilot line 13 is cut off from the tank port 11 and connected to the actuator port 4 or 5 so that the maximum load pressure among load pressures of the individual actuators is selected and introduced.

It is to be noted, however, that if the hydraulic pressure control device is constructed such that the actuator ports 4, 5 are connected to the connecting ports 9 before the pump ports 3 are connected to the interconnecting port 7 when the directional control valve 2 has been switched, the actuator ports 4, 5 are connected to the pilot line 13 which has thus far been kept at the tank pressure during that time lag. A consequence of this is that an instantaneous flow occurs until the pilot line 13 is filled with pressurized oil, causing the load pressure of each actuator to be released into the pilot line 13. In a case where a cylinder is used as an actuator, for example, a load pressure applied to a bottom-side chamber of the cylinder will be introduced into the pilot line 13 when the directional control valve 2 is switched to increase the load pressure, and this causes a shock such as an instantaneous load reduction.

On the contrary, if the hydraulic pressure control device is constructed such that the actuator ports 4, 5 are connected to the connecting ports 9 after the pump ports 3 are connected to the interconnecting port 7 when the directional control valve 2 has been switched, the pressure in the connecting ports 9 will be brought to the pump pressure during the time lag and the pump pressure will be introduced to the pilot line 13. As a consequence, the pump pressure will be increased than the pump pressure in the pilot line 13 by a specified amount by the regulator valve 15 and the regulator 16, eventually causing a rapid increase in the pump delivery pressure. The occurrence of such a pressure boost phenomenon involving the rapid increase in the pump delivery pressure will cause irregularity in operation or energy losses. Also when a sudden increase in pump delivery pressure used to cause actuator startup shocks.

SUMMARY OF THE INVENTION

It is an object of the invention to provide a hydraulic pressure control device which can overcome the aforementioned problems encountered when a directional control valve is switched.

A hydraulic pressure control device of the invention comprises in its basic construction a pump, a directional control valve for controlling oil output from the pump by a variable throttle whose opening can be determined in accordance with the travel of switching of the directional control valve, a pressure compensating valve which maintains pressure on a downstream side of the variable throttle of the directional control valve higher than pressure in a pilot line by a specified amount, a regulator mechanism which maintains pump delivery pressure higher than the pressure in the pilot line by a specified amount, and an actuator to which hydraulic oil pressure-compensated by the pressure compensating valve is supplied in accordance with a position to which the directional control valve has been switched.

In one aspect of the invention, the hydraulic pressure control device further comprises first and second connecting ports connected to an outflow side of the pressure compensating valve, a first check valve which permits flow from the pressure compensating valve to the first connecting port only, and a second check valve which permits flow from the pressure compensating valve to the second connecting port only, the hydraulic pressure control device being constructed such that the first and second connecting ports are connected to a tank when the directional control valve is in its neutral position, one of the first and second connecting ports is cut off from the tank and connected to the actuator and the other is cut off from the tank and closed when the directional control valve has been switched, in accordance with a position to which the directional control valve has been switched, and a maximum pilot pressure selectively taken from between the pressure compensating valve and both check valves is introduced into the pilot line.

In this construction, even when a flow occurs in the pilot line which has been kept at a tank pressure when the directional control valve is switched from the neutral position to a right or left position, the flow will never be admitted into the pilot line as the flow from the actuator is blocked by the check valves. Therefore, even if a cylinder is used as an actuator, for example, a shock such as an instantaneous load reduction will not occur when the directional control valve is switched to increase the load pressure.

Since the first and second connecting ports are formed in the directional control valve and the individual connecting ports are provided with the check valves, it is possible to properly set the timing with which one of the connecting ports is cut off from the tank and connected to the actuator as well as the timing with which the other of the connecting ports is cut off from the tank and closed in accordance with desired flow rate characteristics. Thus, it becomes possible to prevent a pressure boost phenomenon by properly determining such timing.

In another aspect of the invention, the hydraulic pressure control device is constructed such that one of the first and second connecting ports is cut off from the tank and closed after the other is cut off from the tank and connected to the actuator and the pump is connected to the pressure compensating valve when the directional control valve has been switched.

According to this aspect of the invention, the pilot pressure introduced into the pilot line gradually increases up to the load pressure of the actuator. Therefore, the pump delivery pressure can be gradually increased until it becomes higher than the maximum load pressure of individual actuators by a specified amount so that it is possible to smoothly start up the actuators while preventing the pressure boost phenomenon at startup.

DETAILED DESCRIPTION OF THE PREFERRED EMBODIMENTS OF THE INVENTION

FIGS. 1 to 4 show a hydraulic pressure control device according to an embodiment of the invention. The following description of the hydraulic pressure control device focuses mainly on its differences from the earlier-described conventional hydraulic pressure control device, in which identical elements are designated by the same reference numbers and a detailed description of such elements is omitted.

Figure 1:
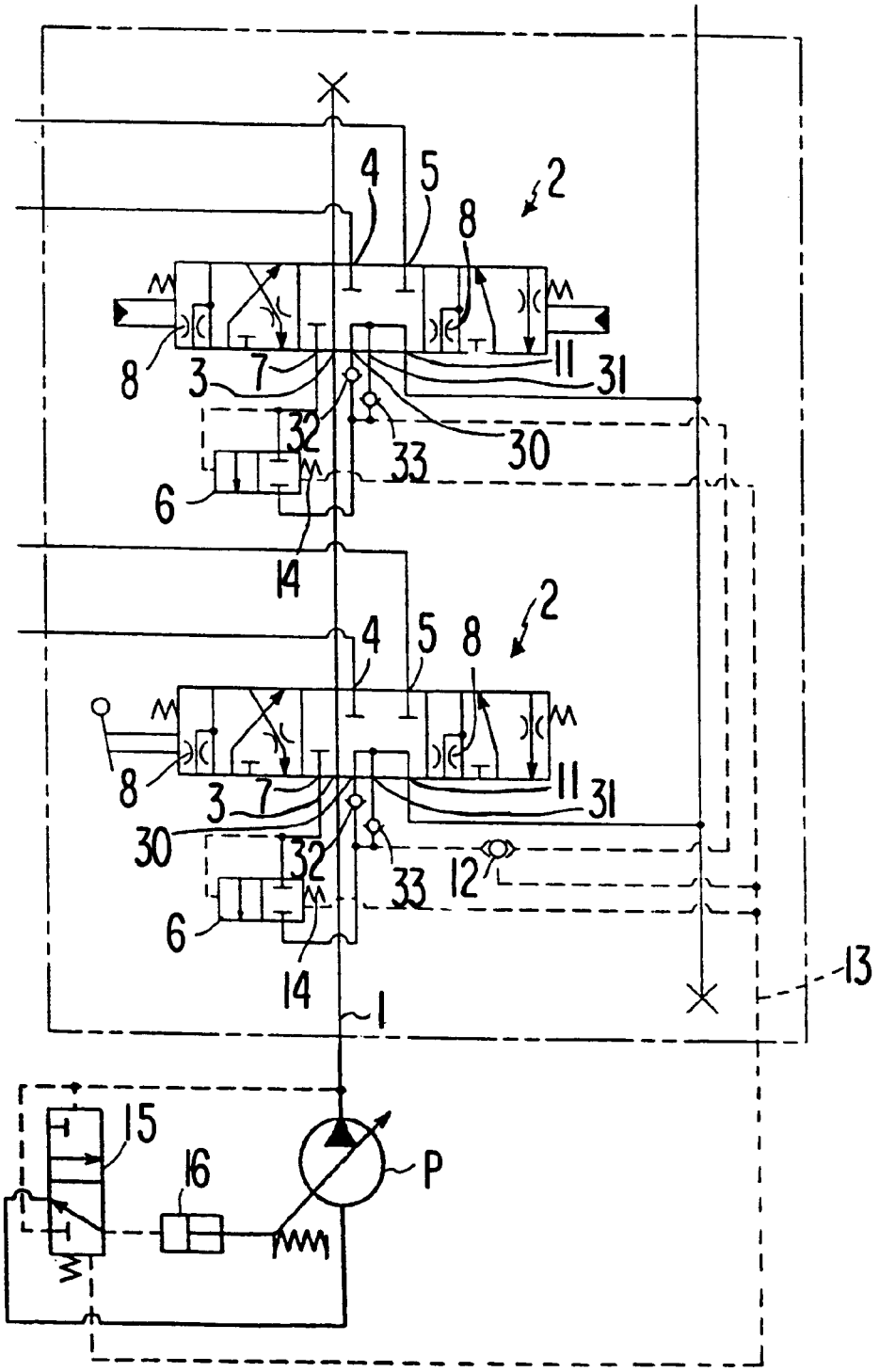
FIG. 1 is a circuit diagram of a hydraulic pressure control device according to an embodiment of the invention.

As can be seen from a circuit diagram of FIG. 1, the hydraulic pressure control device of the embodiment has a dual valve construction incorporating a pair of directional control valves 2 of the same structure and circuit configuration. The following discussion depicts the structure of one of the directional control valves 2 and its associated circuit.

As shown in FIG. 1, a first connecting port 30 and a second connecting port 31 are parallel-connected to an outflow side of a pressure compensating valve 6, with check valves 32 and 33 provided between the pressure compensating valve 6 and the first and second connecting ports 30, 31, respectively, to allow flow from the pressure compensating valve 6 to the respective connecting ports 30, 31 only.

The first and second connecting ports 30, 31 are connected to a tank port 11 when the directional control valve 2 is set to its neutral position. When the directional control valve 2 is switched to the left position of FIG. 1, the first connecting port 30 is cut off from the tank port 11 and connected to an actuator port 5 while the second connecting port 31 is cut off from the tank port 11 and closed. When the directional control valve 2 is switched to the right position of FIG. 1, the second connecting port 31 is cut off from the tank port 11 and connected to an actuator port 4 while the first connecting port 30 is cut off from the tank port 11 and closed.

On the other hand, one of pressures taken from between the pressure compensating valve 6 and the check valves 32, 33 of the pair of directional control valves 2 whichever higher is selected by a shuttle valve 12 and led to a pilot line 13 as a pilot pressure.

When the directional control valve 2 is in its neutral position in the hydraulic pressure control device of the embodiment thus constructed, the pilot line 13 is maintained approximately at a tank pressure through the check valves 32, 33, the first and second connecting ports 30, 31 and the tank port 11. Therefore, a regulator mechanism formed of a regulator valve 15 and a regulator 16 maintains a relatively low standby pressure.

When the directional control valve 2 is switched from the neutral position to the right or left position, one of load pressures of individual actuators taken from between the pressure compensating valve 6 and the check valves 32, 33 of the pair of directional control valves 2 whichever higher is selected by the shuttle valve 12 and led to the pilot line 13.

Even when a flow occurs in the pilot line 13 at this point, a flow from each actuator is blocked by the check valves 32, 33 and will never be admitted into the pilot line 13. Therefore, even if a cylinder is used as an actuator, for example, a shock such as an instantaneous load reduction will not occur when the directional control valve 2 is switched to increase the load pressure.

In practice, the pilot pressure introduced into the pilot line 13 becomes higher than the selected load pressure by a cracking pressure of the check valves 32, 33. If, however, a spring 14 of the pressure compensating valve 6 and a spring of the regulator valve 15 are properly set to cancel out the cracking pressure, it is possible to perform precise control in accordance with the maximum load pressure of the actuators.

Figure 2:
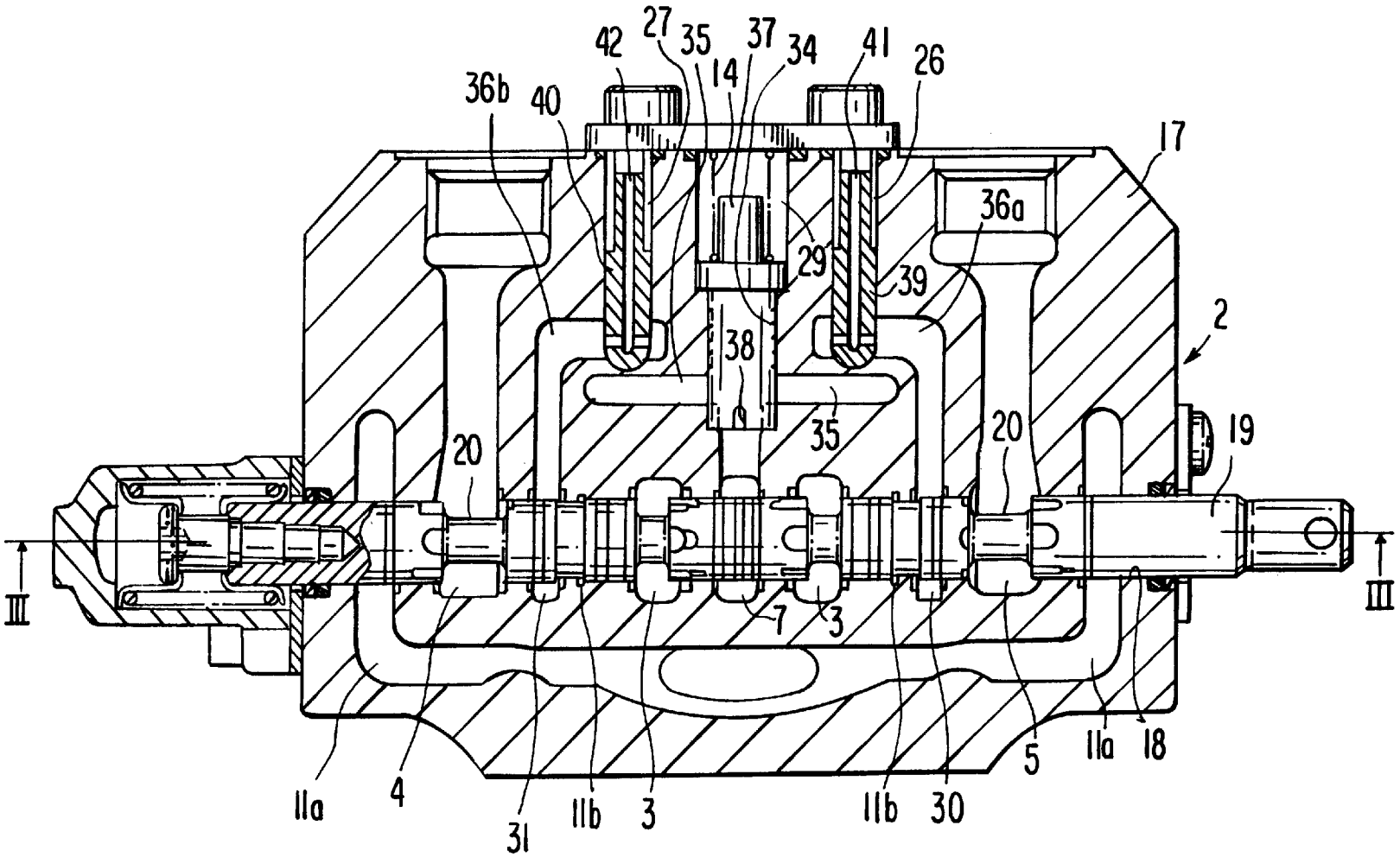
FIG. 2 is a sectional diagram showing a more specific example of the hydraulic pressure control device of the embodiment.

FIG. 2 shows a more specific example of the directional control valve 2, the pressure compensating valve 6 and the check valves 32, 33 of the hydraulic pressure control device of the present embodiment, in which the construction of the directional control valve 2 is almost same as that of the directional control valve 2 of the earlier-described conventional hydraulic pressure control device, the former differing from the latter in that a first connecting port 30 is provided on the inside of an actuator port 5 and a second connecting port 31 is provided on the inside of an actuator port 4.

An assembly hole 34 perpendicular to a spool hole 18 is formed approximately in the middle of a valve body 17, a lower end of the assembly hole 34 being connected to an interconnecting port 7. Right and left side portions of the assembly hole 34 are connected to the first and second connecting ports 30, 31 through right and left passages 35, and passages 36*a* and 36*b*, respectively.

One of pressures taken from the right-hand and left-hand passages 35 whichever higher is selected by a shuttle valve 12 and led to an unillustrated pilot line 13 as a pilot pressure.

A piston 37 which constitutes the pressure compensating valve 6 is slidably fitted in the assembly hole 34. A spring 14 is fitted in a pilot chamber 29 to which a rear end of the piston 37 is directed so that an elastic force of the spring 14 is exerted on the piston 37. As a result, the piston 37 is forced against the lower end of the assembly hole 34 by the elastic force of the spring 14. In this condition, the control cutouts 38 formed on a side surface of the piston 37 are cut off from the passages 35.

The pilot pressure taken from the pilot line 13 is introduced into the pilot chamber 29.

Poppets 39 and 40 which constitute the check valves 32 and 33 are fitted between the right-hand passage 35 and the passage 36*a*, and between the left-hand passage 35 and the passage 36*b*, respectively. The poppets 39 and 40 are brought into contact with their respective seating surfaces by springs 26 and 27 acting on the poppets 39 and 40, respectively. In this condition, both the right-hand and left-hand passages 35 are cut off from the passage 36*a* and the passage 36*b*, respectively.

The internal pressures of the first and second connecting ports 30, 31 are led to back pressure chambers of the poppets 39 and 40 through connecting holes 41 and 42, respectively.

In the hydraulic pressure control device of this embodiment, connecting timing of the individual ports is set as described below.

Figure 3:
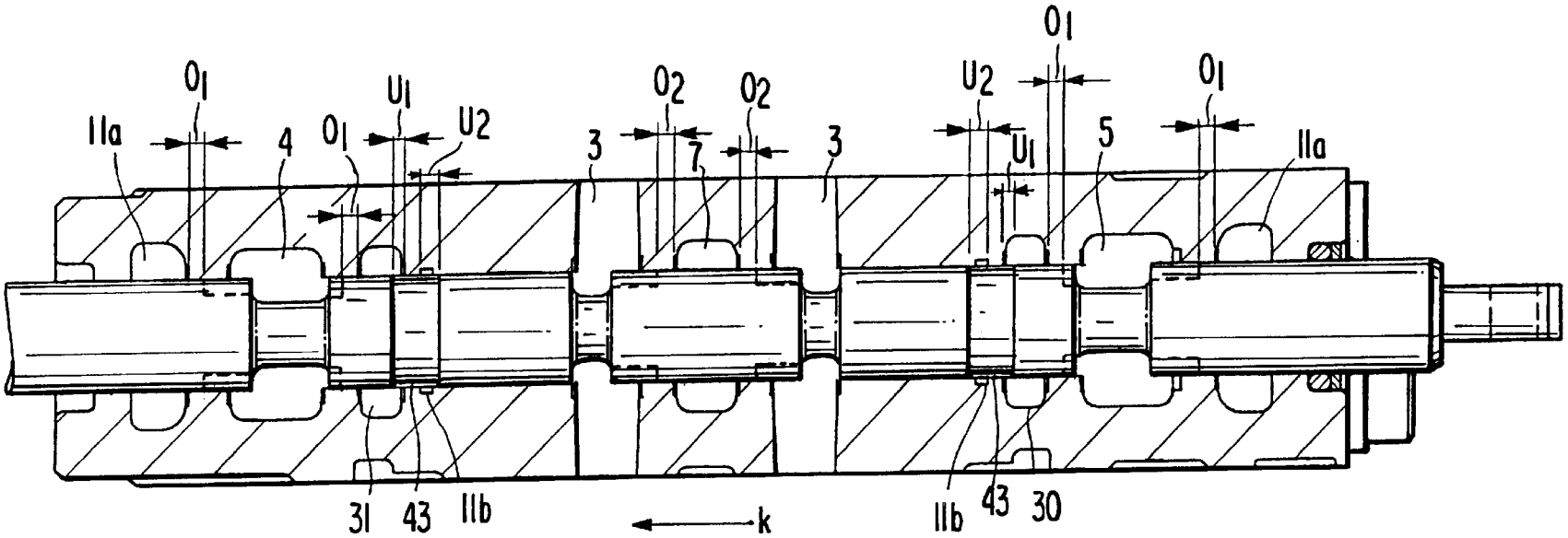
FIG. 3 is a diagram showing lapping conditions of individual ports.

As shown in FIG. 3, the interconnecting port 7 overlaps right and left pump ports 3, in which the amount of each overlap is represented by $O_2$. Similarly, the actuator ports 4, 5 overlap the first and second connecting ports 30, 31, and the amount of each of these overlaps is represented by $O_1$.

On the other hand, the first and second connecting ports 30, 31 and tank ports 11*a* underlap with annular grooves 43 located in between, and the amount of each underlap is represented by $U_1$, $U_2$.

The aforementioned amounts of overlaps and underlaps $O_1$, $O_2$, $U_1$ and $U_2$ have relationships described below.

Here, it is assumed that a spool 19 is now switched to the direction of an arrow k shown in FIG. 3. When the spool 19 is moved as much as the amount of underlap $U_1$ the first connecting port 30 is cut off from its corresponding tank port 11*b* as shown by a characteristic curve A in FIG. 4.

Figure 4:
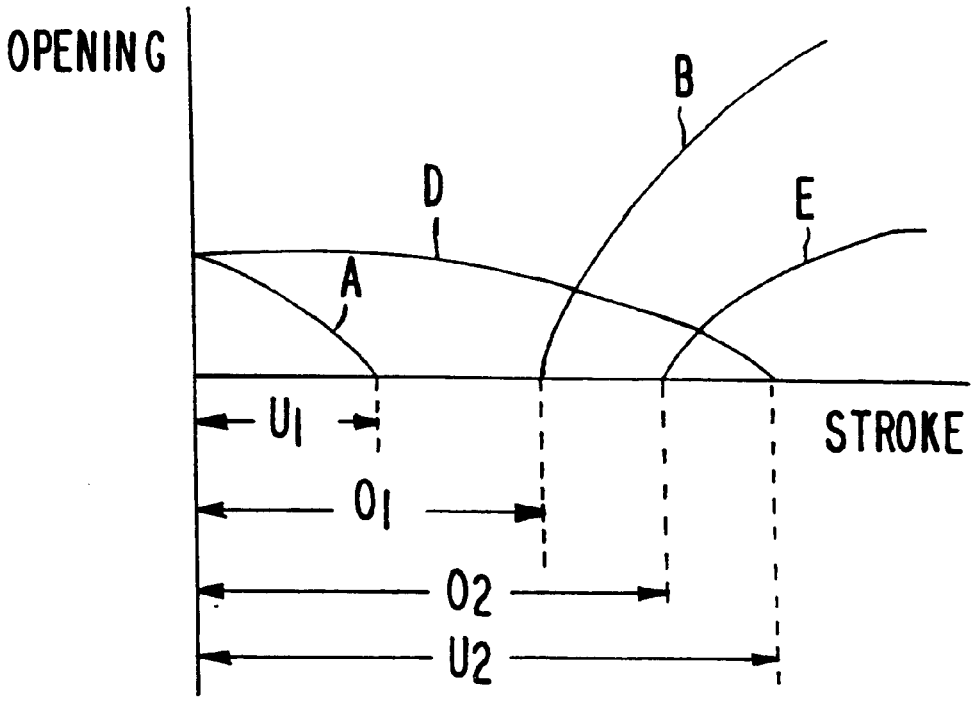
FIG. 4 is a characteristic diagram showing connection and cutoff timing of the individual ports.
Figure 5:
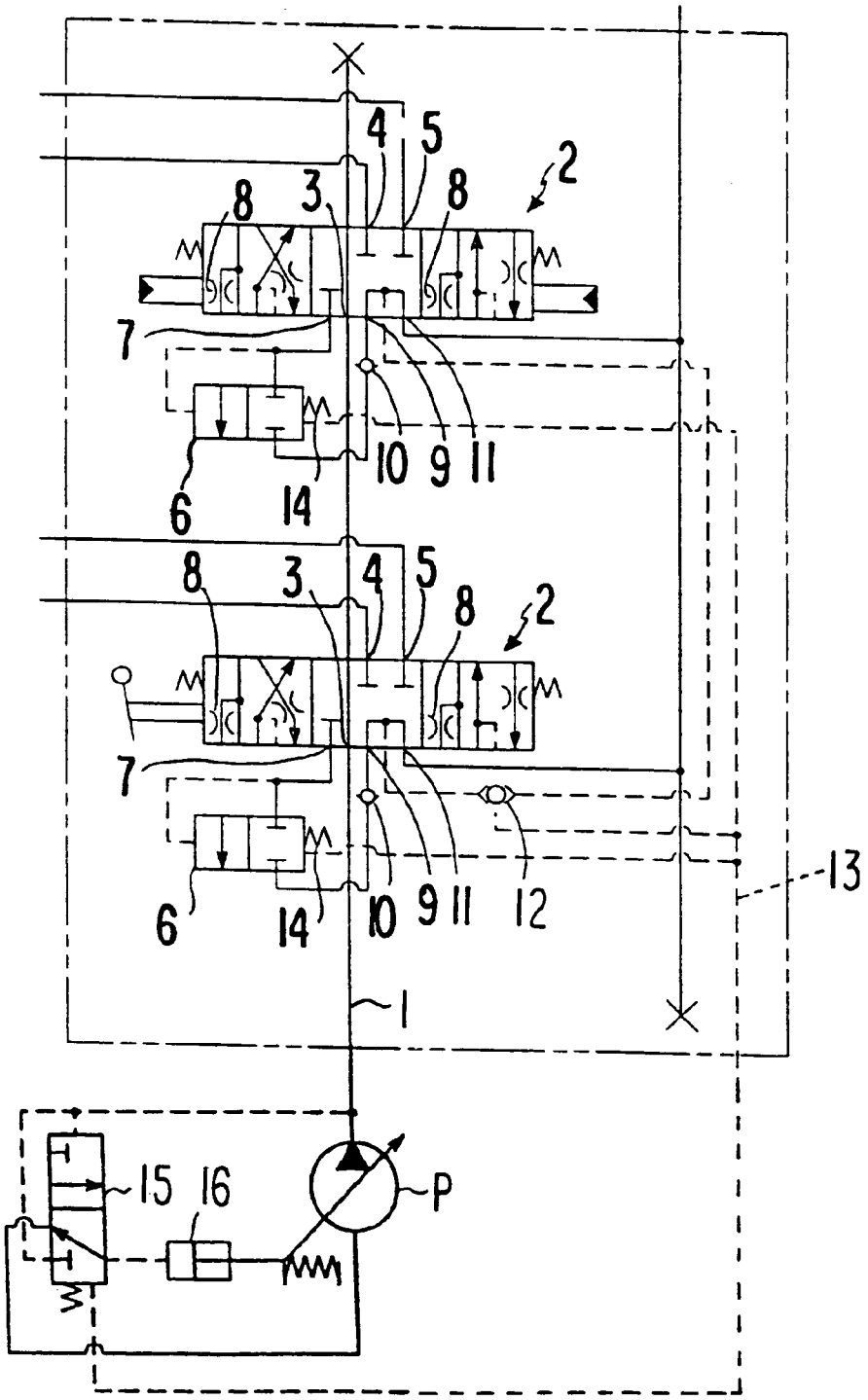
FIG.5 PRIOR ART
FIG. 5 is a circuit diagram of a conventional hydraulic pressure control device.
Figure 6:
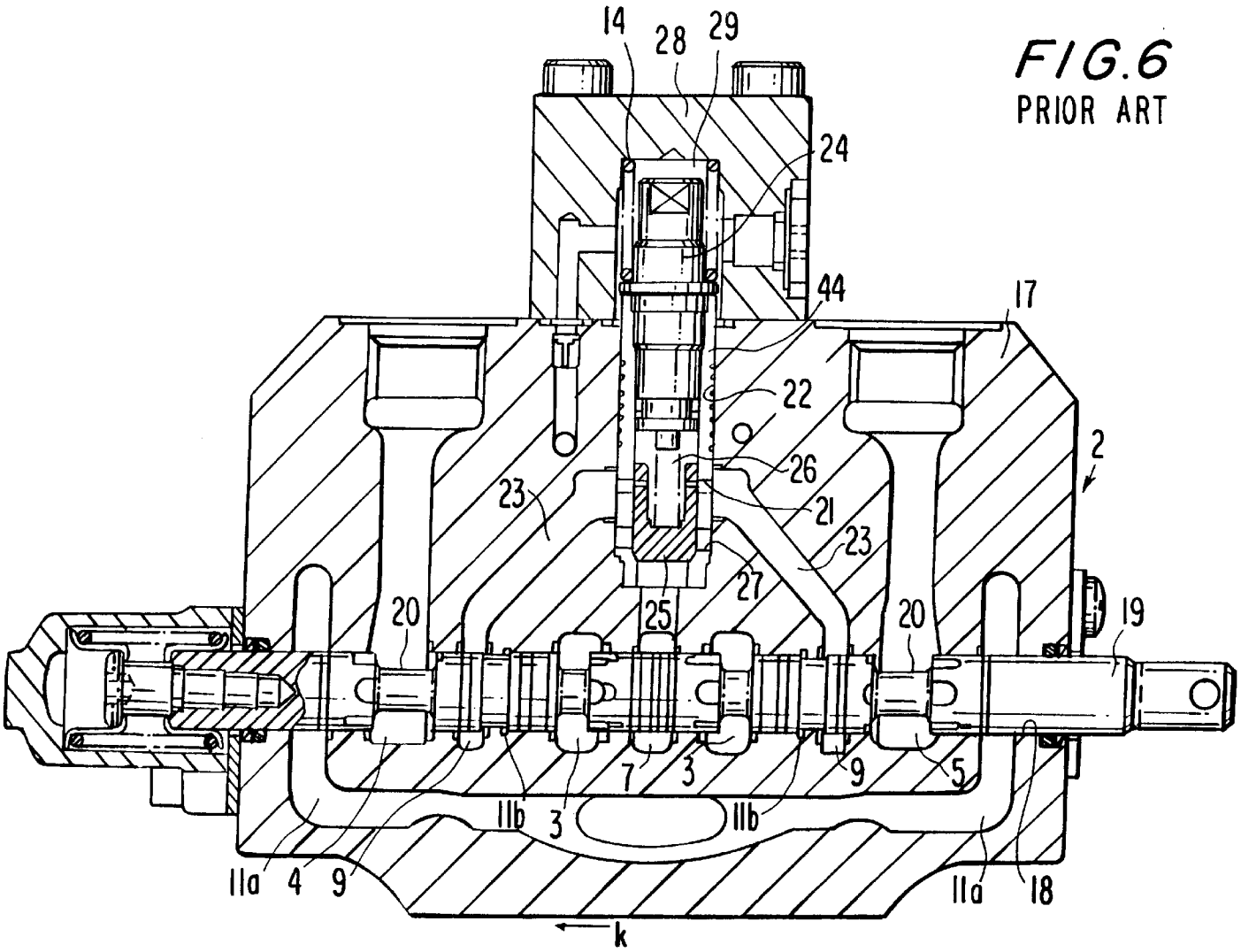
FIG.6 PRIOR ART
FIG. 6 is a sectional diagram showing a more specific example of the conventional hydraulic pressure control device.

When the spool 19 is moved up to the amount of overlap $O_1$, the first connecting port 30 is connected to the actuator port 5 as shown by a characteristic curve B in FIG. 4.

The second connecting port 31 and its corresponding tank port 11*b* near the actuator port 4 are still underlapped up to this point as shown by a characteristic curve D in FIG. 4.

When the spool 19 is shifted up to the amount of overlap $O_2$, the interconnecting port 7 is connected to the pump ports 3 as shown by a characteristic curve E in FIG. 4.

After the interconnecting port 7 has been connected to the pump ports 3, the amount of underlap between the second connecting port 31 and the tank port 11*b* close to the actuator port 4 becomes zero and the second connecting port 31 is cut off from its corresponding tank port 11*b* and closed (characteristic curve D of FIG. 4).

It is possible to prevent the occurrence of a so-called pressure boost phenomenon by setting the connecting timing of the individual ports as described above.

In the aforementioned setting, the interconnecting port 7 is connected to the pump ports 3 (characteristic curve E of FIG. 4) after the first connecting port 30 has been cut off from its corresponding tank port 11*b* and connected to the actuator port 5 (characteristic curves A and B of FIG. 4).

Since the second connecting port 31 remains connected to its corresponding tank port 11*b* on the side of the actuator port 4, however, the passages 35 and the passage 36*b* excluding the passage 36*a* on the side of the first connecting port 30 are maintained at approximately the tank pressure. As this pressure is introduced into the pilot line 13 as the pilot pressure, pump delivery pressure becomes higher than the pilot pressure by a specified amount and is therefore maintained at a relatively low standby pressure.

If the spool 19 is further moved from this condition, the second connecting port 31 on the side of the actuator port 4 is eventually cut off from its corresponding tank port 11*b* and closed (characteristic curve D of FIG. 4).

Since the load pressure of the actuator connected to the first connecting port 30 is introduced to the back pressure chamber of he poppet 39 at this point, the poppet 39 is not opened unless the pressure in the passage 35 becomes as high as the load pressure of that actuator. Therefore, as the pressure in the passage 35 gradually increases, the increasing pressure is selected and led to the pilot line 13 and controls the pump delivery pressure. This means that the pump delivery pressure can be gradually increased until it becomes higher than the maximum load pressure of the actuators by a specified amount so that it is possible to smoothly start up the actuators while preventing the pressure boost phenomenon at startup and an excessive increase in working pressure.

Operation of the hydraulic pressure control device is simply reversed when the spool 19 is switched in the right direction as illustrated. Thus, a detailed description of this case is omitted.

As thus far described, there are formed the first and second connecting ports 30, 31 which are associated with the check valves 32 and 33, respectively, in the directional control valve 2. This construction makes it possible to properly set the timing with which one of the connecting ports 30, 31 is cut off from a tank and connected to the actuator port 4 or 5 as well as the timing with which the other of the connecting ports 30, 31 is cut off from the tank and closed in accordance with desired flow rate characteristics.

If it is desired to prevent the pressure boost phenomenon as described above, it would be sufficient to set operational timing in such a way that one of the connecting ports 30, 31 is cut off from its corresponding tank port 11*b* and closed (characteristic curve D of FIG. 4) after the other of the connecting ports 30, 31 has been cut off from its corresponding tank port 11*b* and connected to the actuator port 4 or 5 and (characteristic curves A and B of FIG. 4) the interconnecting port 7 has been connected to the pump ports 3 (characteristic curve E of FIG. 4).

If it is desired to improve the response of the actuators rather than to prevent the pressure boost phenomenon, it would be sufficient to set operational timing in such a way that one of the connecting ports 30, 31 is cut off from its corresponding tank port 11*b* and closed (characteristic curve D) after the interconnecting port 7 has been connected to the pump ports 3 (characteristic curve E). If the operational timing is set in this way, the pressure in the passage 35 quickly increases because hydraulic oil is introduced from the interconnecting port 7 after the passages 35 have been closed. Since the quickly increasing pressure is selected and led to the pilot line 13 and controls the pump delivery pressure, it is possible to improve the response of the actuators.

In either case, the timing of connecting and cutting off each port may be determined in accordance with desired control characteristics.

What is claimed is:

1. A hydraulic pressure control device for controlling the flow of oil from a pump to a hydraulic actuator, said device comprising:

a directional control valve having a body, said directional control valve operably connected to said pump for controlling oil output from said pump by a variable throttle whose opening can be determined in accordance with the travel of switching of said directional control valve, said directional control valve having a pair of tank ports, right and left pump ports, first and second connecting ports, a pair of actuator ports, an interconnecting port and a pair of annular grooves, said interconnecting port overlapping said right and left pump ports by an amount $O_2$ and a respective one of said pair of actuator ports overlapping said first and second connecting ports by an amount $O_1$, each of said first and second connecting ports underlapping with a respective one of said annular grooves by an amount $U_1$ and each of said tank ports underlapping with a respective one of said annular grooves by an amount $U_2$, and wherein said overlapping $O_1$, $O_2$ and underlapping amounts $U_1$, $U_2$ have a relationship of $U_1<O_1<O_2<U_2$;

a pressure compensating valve for maintaining pressure on a downstream side of the variable throttle of said directional control valve higher than a pressure in a pilot line by a specified amount, said pressure compensating valve having an inflow side operably connected to said directional control valve and a outflow side connected to said first and second connecting ports;

a regulator mechanism operably connected to said pump which maintains pump delivery pressure higher than the pressure in said pilot line by a specified amount;

a first check valve which permits flow from said pressure compensating valve to said first connecting port only;

a second check valve which permits flow from said pressure compensating valve to said second connecting port only;

a spool slidably movable within the body of said directional control valve for controlling the opening and closing the ports of said directional control valve and wherein said spool is structured and arranged so that when said spool is moved an amount equal to $U_1$ said first connecting port is switched from an open state with resect to a corresponding one of said pair of tank ports to a closed state, and when said spool is moved an amount equal to $O_1$ said first connecting port is connected to a correspond one of said pair of actuator ports, and when said spool is moved an amount equal to $O_2$ said interconnecting port is connected to said right and left pump ports and when said spool is moved and amount equal to $U_2$ said second connecting port is switched from an open state with resect to a corresponding one of said tank ports to a closed state.

* * * * *